US006589926B1

(12) United States Patent
Vinson et al.

(10) Patent No.: US 6,589,926 B1
(45) Date of Patent: Jul. 8, 2003

(54) DISHWASHING DETERGENT COMPOSITIONS CONTAINING ORGANIC DIAMINES

(75) Inventors: Phillip Kyle Vinson, Fairfield, OH (US); Janice Lee Oglesby, West Harrison, IN (US); William Michael Scheper, Lawrenceburg, IN (US); Chandrika Kasturi, Cincinnati, OH (US); Kofi Ofosu-Asante, Cincinnati, OH (US); Joanna Margaret Clarke, Brussels (BE); Robert Owens, Cincinnati, OH (US); Artemio Castro, West Chester, OH (US); Garry Kenneth Embleton, Strombeek-Bever (BE)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/701,802

(22) PCT Filed: Feb. 6, 1999

(86) PCT No.: PCT/US99/02553

§ 371 (c)(1),
(2), (4) Date: Dec. 1, 2000

(87) PCT Pub. No.: WO99/63034

PCT Pub. Date: Dec. 9, 1999

Related U.S. Application Data

(60) Provisional application No. 60/087,693, filed on Jun. 2, 1998.

(51) Int. Cl.[7] ..... C11D 1/02; C11D 1/75; C11D 1/83; C11D 3/30

(52) U.S. Cl. ..... 510/237; 510/423; 510/424; 510/427; 510/433; 510/434; 510/435; 510/499; 510/503

(58) Field of Search ..... 510/237, 423, 510/424, 427, 433, 434, 435, 499, 503

(56) References Cited

U.S. PATENT DOCUMENTS

| | | | | |
|---|---|---|---|---|
| 2,267,205 A | | 12/1941 | Kyrides | |
| 3,003,970 A | | 10/1961 | Call | |
| 3,173,876 A | | 3/1965 | Zobrist | |
| 3,309,321 A | | 3/1967 | McMaster | |
| 3,839,234 A | | 10/1974 | Roscoe | |
| 3,935,129 A | | 1/1976 | Jabalee | |
| 4,001,123 A | | 1/1977 | Renold | |
| 4,077,896 A | | 3/1978 | Bunegar et al. | |
| 4,368,146 A | | 1/1983 | Aronson et al. | |
| 4,547,301 A | | 10/1985 | Ooms | |
| 4,556,509 A | | 12/1985 | Demangeon et al. | |
| 4,579,681 A | | 4/1986 | Ruppert et al. | |
| 5,158,612 A | | 10/1992 | Savoly et al. | |
| 5,308,532 A | | 5/1994 | Adler et al. | |
| 5,409,639 A | | 4/1995 | Fusiak et al. | |
| 5,484,555 A | | 1/1996 | Scheper | |
| 5,811,386 A | | 9/1998 | Mueller et al. | |
| 5,990,065 A | * | 11/1999 | Vinson et al. | 510/237 |
| 6,069,122 A | * | 5/2000 | Vinson et al. | 510/235 |
| 6,207,631 B1 | * | 3/2001 | Kasturi et al. | 510/237 |

FOREIGN PATENT DOCUMENTS

| | | |
|---|---|---|
| EP | 0232092 A2 | 8/1987 |
| EP | 0276501 A2 | 8/1988 |
| EP | 0414581 A1 | 2/1991 |
| EP | 0449503 A2 | 10/1991 |
| EP | 0494554 A1 | 7/1992 |
| EP | 0560519 A2 | 9/1993 |
| EP | 0595590 A2 | 5/1994 |
| GB | 2104091 A | 3/1983 |
| JP | 57 044700 | 3/1982 |
| JP | 2550036 A | 3/1988 |
| WO | WO 95/19951 A1 | 7/1995 |
| WO | WO 96/02622 A1 | 2/1996 |
| WO | WO 96/37597 A1 | 11/1996 |
| WO | WO 98/28393 A1 | 7/1998 |

* cited by examiner

*Primary Examiner*—Gregory Delcotto
(74) *Attorney, Agent, or Firm*—C. Brant Cook; Kim W. Zerby; Steve W. Miller

(57) ABSTRACT

Detergent compositions containing low molecular weight organic diamines are provided. More particularly, detergent compositions for hand dishwashing which have improved grease removal performance and benefits in sudsing are provided. Further, such detergent compositions have improved low temperature stability properties and dissolution properties.

20 Claims, No Drawings

DISHWASHING DETERGENT COMPOSITIONS CONTAINING ORGANIC DIAMINES

RELATED APPLICATIONS

This application is a 371 Application of International Application No. PCT/US99/02553 filed Feb. 6, 1999, which claims priority to U.S. Provisional Application Ser. No. 60/087,693 filed Jun. 2, 1998.

FIELD OF THE INVENTION

The present invention relates to detergent compositions containing low molecular weight organic diamines. More particularly, the invention is directed to detergent compositions for hand dishwashing which have improved grease removal performance and benefits in sudsing. The detergents of this invention also have improved low temperature stability properties and superior dissolution, as well as improved tough food stain removal, and antibacterial properties.

When formulated into hand dishwashing detergents the diamines are effective as replacements for the low-level use of Ca/Mg ions as surfactancy boosters long known in the dishwashing art. The diamines provide simultaneous benefits in grease cleaning, sudsing, dissolution, hard water cleaning benefits and low temperature stability, without the shortcomings associated with Ca/Mg.

BACKGROUND OF THE INVENTION

Typical commercial hand dishwashing compositions incorporate divalent ions (Mg, Ca) to ensure adequate grease performance in soft water. However, the presence of divalent ions in formulas containing anionic, nonionic, or additional surfactants (e.g., amine oxide, alkyl ethoxylate, alkanoyl glucose amide, alkyl betaines) leads to slower rates of product mixing with water (and hence poor flash foam), poor rinsing, and poor low temperature stability properties. Moreover, preparation of stable dishwashing detergents containing Ca/Mg is very difficult due to the precipitation issues associated with Ca and Mg as pH increases. The inclusion of Amine oxide and an anionic surfactant in a detergent composition suitable for hand dishwashing is highly desirable as the combination of surfactants not only provide superior cleaning, they also provide improved sudsing of the formula, especially in solutions which contain particulate soil. It is also well known that levels of amine oxide of greater than 2% in combination with anionic surfactant and Ca/Mg detergent composition lead to low temperature stability issues, such as solidification of product below 5° C. Consequently, there remains the need for a detergent composition suitable for hand dishwashing, which is stable at low temperatures, and additionally can provide grease removal and tough food cleaning benefits, in hard water and at pH's, typically pH 9 or lower, where a conventional Ca/Mg system would be unstable and not provide grease removal and tough food cleaning benefits.

BACKGROUND ART

U.S. Pat. No. 4,556,509 and JP 63131124-A 88/06/03.

SUMMARY OF THE INVENTION

It has now been determined that the use of certain organic diamines, as outlined in detail below, in combination with amine oxides and anionic surfactants in a specific mole ratio leads to improved cleaning of tough food stains and removal of grease/oil when compared to the use of Mg or Ca ions in conventional detergent compositions. Unexpectedly, these organic diamines also improve suds stability in the presence of soils, esp. soils containing fatty acids and proteins.

Further, the strong grease removal performance of the diamines discussed herein allows elimination of Mg/Ca ions from the formulation while maintaining benefits in grease performance. The elimination of Mg/Ca additionally leads to improved benefits in dissolution, rinsing and low temperature product stability.

The detergent compositions according to the first aspect of the present invention comprise:

a) a low molecular weight organic diamine having a pK1 and a pK2, wherein the pK1 and the pK2 of said diamine are both in the range of from about 8.0 to about 11.5;

b) an anionic surfactant;

c) a amine oxide surfactant;

said compositions being substantially free of magnesium and calcium salts; wherein the pH (as measured as 10% aqueous solution) is from about 5.0 to about 12.5 and wherein mole ratio of said anionic surfactant to said amine oxide to said diamine is from about 100:40:1 to about 9:0.5:1.

In accordance with a second aspect of the present invention detergent composition suitable for use in hand dishwashing, said composition comprising:

a) from about 0.1% to about 5%, by weight of a diamine having a molecular weight less than or equal to 400 g/mol;

b) from about 5% to about 50%, by weight, of an anionic surfactant;

c) from about 0.5% to about 10%, by weight, of an amine oxide surfactant;

d) from about 0.001% to about 2%, by weight, of a perfume;

e) from about 0.01% to about 5%, by weight, of a polymeric suds stabilizer selected from the group consisting of:

i) homopolymers of (N,N-dialkylamino)alkyl acrylate esters having the formula:

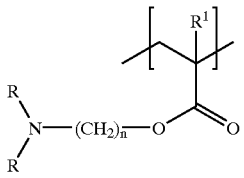

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

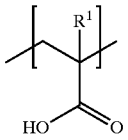

wherein $R^1$ is hydrogen, C1C6 alkyl, and mixtures thereof; provided that the ratio of (ii) to (i) is from about 2 to 1 to about 1 to 2; and wherein said polymeric suds stabilizer has a molecular weight of from about 1,000 to about 2,000,000 daltons;

said compositions being substantially free of magnesium and calcium salts; wherein the pH (as measured as 10% aqueous solution) is from about 5.0 to about 12.5 and wherein mole ratio of said anionic surfactant to said amine oxide to said diamine is from about 27:8:1 to about 11:3:1.

According to a third aspect of the present invention a detergent composition suitable for use in hand dishwashing, the composition comprising:

a) a low molecular weight organic diamine having a pK1 and a pK2, wherein the pK1 and the pK2 of said diamine are both in the range of from about 8.0 to about 11.5;

b) an anionic surfactant;

said compositions being substantially free of magnesium and calcium salts; wherein the pH (as measured as 10% aqueous solution) is from about 5.0 to about 12.5 and wherein mole ratio of said anionic surfactant to said diamine is greater than 9:1.

All parts, percentages and ratios used herein are expressed as percent weight unless otherwise specified. All documents cited are, in relevant part, incorporated herein by reference.

DETAILED DESCRIPTION OF THE INVENTION

Definitions—The present detergent compositions comprise an "effective amount"or a "grease removal-improving amount" of individual components defined herein. By an "effective amount" of the diamines herein and adjunct ingredients herein is meant an amount which is sufficient to improve, either directionally or significantly at the 90% confidence level, the performance of the cleaning composition against at least some of the target soils and stains. Thus, in a composition whose targets include certain grease stains, the formulator will use sufficient diamine to at least directionally improve cleaning performance against such stains. Importantly, in a fully-formulated detergent the diamine can be used at levels which provide at least a directional improvement in cleaning performance over a wide variety of soils and stains, as will be seen from the examples presented hereinafter.

As noted, the diamines are used herein in detergent compositions in combination with detersive surfactants at levels which are effective for achieving at least a directional improvement in cleaning performance. In the context of a hand dishwashing composition, such "usage levels" can vary depending not only on the type and severity of the soils and stains, but also on the wash water temperature, the volume of wash water and the length of time the dishware is contacted with the wash water.

Since the habits and practices of the users of detergent compositions show considerable variation, the composition will preferably contain at least about 0.1%, more preferably at least about 0.2%, even more preferably, at least about 0.25%, even more preferably still, at least about 0.5% by weight of said composition of diamine. The composition will also preferably contain no more than about 15%, more preferably no more than about 10%, even more preferably, no more than about 6%, even more preferably, no more than about 5%, even more preferably still, no more than about 1.5% by weight of said composition of diamine.

In one of its several aspects, this invention provides a means for enhancing the removal of greasy/oily soils by combining the specific diamines of this invention with surfactants. Greasy/oily "everyday" soils are a mixture of triglycerides, lipids, complex polysaccharides, fatty acids, inorganic salts and proteinaceous matter.

Without being limited by theory, it is believed that the strong grease performance benefits achieved by the organic diamines across a broad range of hardness (up to about 1,000 ppm expressed as $CaCO_3$) eliminating the need for divalent ions in the hand dishwashing detergent to bolster grease performance in soft water. Significantly, the elimination of divalent ions from conventional hand dishwashing formulas leads to benefits in rate of product mixing with water (termed "dissolution"), flash foam, rinsing, and low temperature stability.

Depending on consumer preferences, the compositions herein may be formulated at viscosities of over about 50, preferably over about 100 centipoise, and more preferably from about 100 to about 400 centipoise. For European formulations, the compositions may be formulated at viscosites of up to about 1000 centipoise.

Moreover, the superior rate of dissolution achieved by divalent ion elimination even allows the formulator to make hand dishwashing detergents, especially compact formulations, at even significantly higher viscosities (e.g., 1,000 centipoise or higher) than conventional formulations while maintaining excellent dissolution and cleaning performance. This has significant potential advantages for making compact products with a higher viscosity while maintaining acceptable dissolution. By "compact" or "Ultra" is meant detergent formulations with reduced levels of water compared to conventional liquid detergents. The level of water is less than 50%, preferably less than 30% by weight of the detergent compositions. Said concentrated products provide advantages to the consumer who has a product which can be used in lower amounts and to the producer, who has lower shipping costs.

Diamines—It is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation. Additionally, if amine oxide and/or other surfactants are present, the amine oxide or surfactant should be hydrogen peroxide-free, especially when the compositions contain enzymes. The preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide. However, conventional amine oxides, namely those which are not free of hydrogen peroxide, can be used in the compositions of the present invention.

Making the compositions free of hydrogen peroxide is important when the compositions contain an enzyme. The peroxide can react with the enzyme and destroy any performance benefits the enzyme adds to the composition. Even small amounts of hydrogen peroxide can cause problems with enzyme containing formulations. However, the diamine can react with any peroxide present and act as an enzyme stabilizer and prevent the hydrogen peroxide from reacting with the enzyme. The only draw back of this stabilization of the enzymes by the diamine is that the nitrogen compounds produced are believed to cause the malodors which can be present in diamine containing compositions. Having the diamine act as an enzyme stabilizer also prevents the diamine from providing the benefits to the composition for which it was originally put in to perform, namely, grease cleaning, sudsing, dissolution and low temperature stability. Therefore, it is preferred to minimize the amount of hydrogen peroxide present as an impurity in the inventive compositions either by using components which are substantially free of hydrogen peroxide and/or by using non-diamine antioxidants even though the diamine can act as an enzyme stabilizer, because of the possible generation of malodorous compounds and the reduction in the amount of diamine available present to perform its primary role.

It is further preferred that the compositions of the present invention be "malodor" free. That is, that the odor of the headspace does not generate a negative olfactory response from the consumer. This can be achieved in many ways, including the use of perfumes to mask any undesirable odors, the use of stabilizers, such as antioxidants, chelants etc., and/or the use of diamines which are substantially free of impurities. It is believed, without wanting to being limited by theory, that it is the impurities present in the diamines that are the cause of most of the malodors in the compositions of the present invention. These impurities can form during the preparation and storage of the diamines. They can also form during the preparation and storage of the inventive composition. The use of stabilizers such as antioxidants and chelants inhibit and/or prevent the formation of these impurities in the composition from the time of preparation to ultimate use by the consumer and beyond. Hence, it is most preferred to remove, suppress and/or prevent the formation of these malodors by the addition of perfumes, stabilizers and/or the use of diamines which are substantially free from impurities.

Preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3-bis (methylamine)-cyclohexane, 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=1.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, N.Y. and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, N.Y., 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

The diamines useful herein can be defined by the following structure:

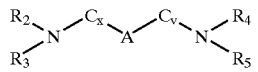

wherein $R_{2-5}$ are independently selected from H, methyl, —$CH_3CH_2$, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater.

Alternatively the preferred diamines can be those with a molecular weight less than or equal to 400 g/mol. It is preferred that these diamines have the formula:

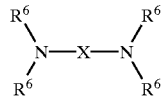

wherein each $R^6$ is independently selected from the group consisting of hydrogen, $C_1$–$C_4$ linear or branched alkyl, alkyleneoxy having the formula:

$$—(R^7O)_mR^8$$

wherein $R^7$ is $C_2$–$C_4$ linear or branched alkylene, and mixtures thereof; $R^8$ is hydrogen, $C_1$–$C_4$ alkyl, and mixtures thereof; m is from 1 to about 10; X is a unit selected from:

i) $C_3$–$C_{10}$ linear alkylene, $C_3$–$C_{10}$ branched alkylene, $C_3$–$C_{10}$ cyclic alkylene, $C_3$–$C_{10}$ branched cyclic alkylene, an alkyleneoxyalkylene having the formula:

$$—(R^7O)_mR^7—$$

wherein $R^7$ and m are the same as defined herein above;

ii) $C_3$–$C_{10}$ linear, $C_3$–$C_{10}$ branched linear, $C_3$–$C_{10}$ cyclic, $C_3$–$C_{10}$ branched cyclic alkylene, $C_6$–$C_{10}$ arylene, wherein said unit comprises one or more electron donating or electron withdrawing moieties which provide said diamine with a pKa greater than about 8; and iii) mixtures of (i) and (ii) provided said diamine has a $pK_a$ of at least about 8.

Examples of preferred diamines include the following:

Dimethyl aminopropyl amine:

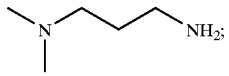

1,6-Hexane Diamine:

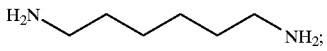

1,3propane diamine—

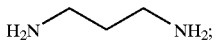

2-methyl 1,5 pentane diamine—

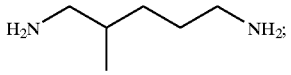

1,3pentandeiamine, available under the tradename Dytek EP

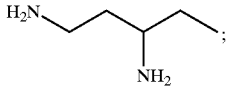

1,3-diaminobutane,—

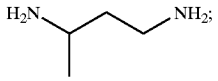

1,2-bis(2-aminoethoxy)ethane, (also known as Jeffamine EDR 148),—

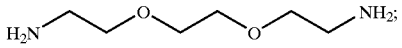

Isophorone diamine—

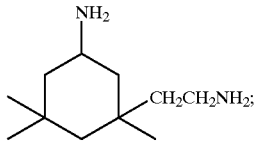

1,3-bis(methylamine)-cyclohexane

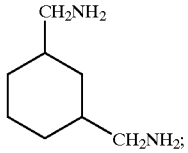

and mixtures thereof.

Polymeric Suds Stabilizer—The compositions of the present invention may optionally contain a polymeric suds stabilizer. These polymeric suds stabilizers provide extended suds volume and suds duration without sacrificing the grease cutting ability of the liquid detergent compositions. These polymeric suds stabilizers are selected from:

i) homopolymers of (N,N-dialkylamino)alkyl acrylate esters having the formula:

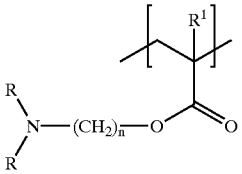

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

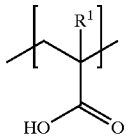

wherein $R^1$ is hydrogen, C1–C6 alkyl, and mixtures thereof, provided that the ratio of (ii) to (i) is from about 2 to 1 to about 1 to 2; The molecular weight of the polymeric suds boosters, determined via conventional gel permeation chromatography, is from about 1,000 to about 2,000,000, preferably from about 5,000 to about 1,000,000, more preferably from about 10,000 to about 750,000, more preferably from about 20,000 to about 500,000, even more preferably from about 35,000 to about 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely

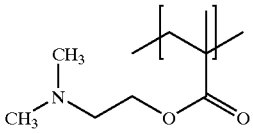

When present in the compositions, the polymeric suds booster may be present in the composition from about 0.01% to about 15%, preferably from about 0.05% to about 10%, more preferably from about 0.1% to about 5%, by weight.

Anionic Surfactants—The anionic surfactants useful in the present invention are preferably selected from the group consisting of, linear alkylbenzene sulfonate, alpha olefin sulfonate, paraffin sulfonates, alkyl ester sulfonates, alkyl sulfates, alkyl alkoxy sulfate, alkyl sulfonates, alkyl alkoxy carboxylate, alkyl alkoxylated sulfates, sarcosinates, taurinates, and mixtures thereof. An effective amount, typically from about 0.5% to about 90%, preferably about 5% to about 50%, more preferably from about 10 to about 30%, by weight of anionic detersive surfactant can be used in the present invention.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali (Group IA) metal cation (e.g., sodium, potassium, lithium), substituted or unsubstituted ammonium cations such as methyl-, dimethyl-, and trimethyl ammonium and quaternary anmmonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl alkoxylated sulfate surfactants are another category of useful anionic surfactant. These surfactants are water soluble salts or acids typically of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines, e.g. monoethanolamine, diethanolamine and triethanolamine, and mixtures thereof. Exemplary surfactants are $C_{12}$–$C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium. Surfactants for use herein can be made from natural or synthetic alcohol feedstocks. Chain lengths represent average hydrocarbon distributions, including branching.

Examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Amine Oxide—Amine oxides are semi-polar nonionic surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)_xN(\overset{\overset{\displaystyle O}{|}}{}R^5)_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Preferably the amine oxide is present in the composition in an effective amount, more preferably from about 0.1% to about 20%, even more preferably about 0.1% to about 15%, even more preferably still from about 0.5% to about 1 0%,by weight. Examples of suitable amine oxide surfactants are given in "Surface Active Agents and Detergents" (Vol. I and II by Schwartz, Perry and Berch).

Secondary Surfactants—Secondary detersive surfactant can be selected from the group consisting of nonionics, cationics, ampholytics, zwitterionics and mixtures thereof. By selecting the type and amount of detersive surfactant, along with other adjunct ingredients disclosed herein, the present detergent compositions can be formulated to be used in the context of laundry cleaning or in other different cleaning applications, particularly including dishwashing. The particular surfactants used can therefore vary widely depending upon the particular end-use envisioned. Suitable secondary surfactants are described below. Examples of suitable nonionic, cationic amphoteric and zwitterionic surfactants are given in "Surface Active Agents and Detergents" (Vol. I and II by Schwartz, Perry and Berch).

Nonionic Detergent Surfactants—Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants include: alkyl ethoxylate, alkanoyl glucose amide, alkyl betaines, sulfobetaine and mixtures thereof.

The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepai® CO-630, marketed by the GAF Corporation and Triton® X-45, X-114, X-100, and X-102, all marketed by the Rohm & Haas Company. These compounds are commonly referred to as alkyl phenol alkoxylates, (e.g., alkyl phenol ethoxylates).

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol® 15-S-9 (the condensation product of $C_{11}$–$C_{15}$ linear secondary alcohol with 9 moles ethylene oxide), Tergitol® 24-L-6 NMW (the condensation product of $C_{12}$–$C_{14}$ primary alcohol with 6 moles ethylene oxide with a narrow molecular weight distribution), both marketed by Union Carbide Corporation; Neodol® 45-9 (the condensation product of $C_{14}$–$C_{15}$ linear alcohol with 9 moles of ethylene oxide), Neodol® 23-6.5 (the condensation product of $C_{12}$–$C_{13}$ linear alcohol with 6.5 moles of ethylene oxide), Neodol® 45-7 (the condensation product of $C_{14}$–$C_{15}$ linear alcohol with 7 moles of ethylene oxide), Neodol® 45-4 (the condensation product of $C_{14}$–$C_{15}$ linear alcohol with 4 moles of ethylene oxide), marketed by Shell Chemical Company, and Kyro® EOB (the condensation product of $C_{13}$–$C_{15}$ alcohol with 9 moles ethylene oxide), marketed by The Procter & Gamble Company. Other commercially available nonionic surfactants include Dobanol 91-8® marketed by Shell Chemical Co. and Genapol UD-080® marketed by Hoechst. This category of nonionic surfactant is referred to generally as "alkyl ethoxylates."

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Fatty acid amide surfactants having the formula:

$$R^6\overset{\overset{\displaystyle O}{\|}}{C}N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and —$(C^2H_4O)_xH$ where x varies from about 1 to about 3.

Preferred amides are $C_8$–$C_{20}$ ammonia amides, monoethanolamides, diethanolamides, and isopropanolamides.

Preferably the nonionic surfactant, when present in the composition, is present in an effective amount, more preferably from about 0.1% to about 20%, even more preferably about 0.1% to about 15%, even more preferably still from about 0.5% to about 10%,by weight.

Polyhydroxy Fatty Acid Amide Surfactant—The detergent compositions hereof may also contain an effective amount of polyhydroxy fatty acid amide surfactant. By "effective amount" is meant that the formulator of the composition can select an amount of polyhydroxy fatty acid amide to be incorporated into the compositions that will improve the cleaning performance of the detergent composition. In general, for conventional levels, the incorporation of about 1%, by weight, polyhydroxy fatty acid amide will enhance cleaning performance.

The detergent compositions herein will typically comprise about 1% weight basis, polyhydroxy fatty acid amide surfactant, preferably from about 3% to about 30%, of the polyhydroxy fatty acid amide. The polyhydroxy fatty acid amide surfactant component comprises compounds of the structural formula:

$$R^2\overset{\overset{\displaystyle O}{\|}}{C}N\underset{\underset{\displaystyle R^1}{|}}{Z}$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2—(CHOH)_4—CHO_2OH$.

R' can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amnidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

Ratio of anionic to amine oxide to diamine

In some of the aspects of the compositions of the present invention the mole ratio of the anionic surfactant:amine oxide:diamine is from about 100:40:1 to about 9:0.5:1, preferably from about 27:8:1 to about 11:3:1. It has been found that detergent compositions containing anionic surfactant, amine oxide and diamine in this specific mole ratio range provide improved low temperature stability, deliver better grease removal and tough food cleaning benefits at pH less than 12.5, and improved hard water cleaning.

In another aspect of the present invention the mole ratio of anionic surfactant to diamine of greater than 9:1, preferably greater than 20:1, has been found to give improved low temperature stability, deliver better grease removal and tough food cleaning benefits and improved hard water cleaning.

Builder—The compositions according to the present invention may further comprise a builder system. Any conventional builder system is suitable for use herein including aluminosilicate materials, silicates, polycarboxylates and fatty acids, materials such as ethylene-diamine tetraacetate, metal ion sequestrants such as arninopolyphosphonates, particularly ethylenediamine tetramethylene phosphonic acid and diethylene triarnine pentamethylene-phosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH) CH2(COOH) wherein R is C10–20 alkyl or alkenyl, preferably C12–16, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

Detergency builder salts are normally included in amounts of from 3% to 50% by weight of the composition preferably from 5% to 30% and most usually from 5% to 25% by weight.

OPTIONAL DETERGENT INGREDIENTS

Enzymes—Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase. Enzymes when present in the compositions, at from about 0.0001% to about 5% of active enzyme by weight of the detergent composition.

Proteolytic Enzyme—The proteolytic enzyme can be of animal, vegetable or microorganism (preferred) origin. The proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis.*

Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®) (Delft. Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Other proteases are sold under the tradenames: Primase, Durazym, Opticlean and Optimase. Preferred proteolytic enzymes, then, are selected from the group consisting of Alcalase® (Novo Industri A/S), BPN', Protease A and Protease B (Genencor), and mixtures thereof. Protease B is most preferred.

Of particular interest for use herein are the proteases described in U.S. Pat. No. 5,470,733.

Also proteases described in our co-pending application U.S. Ser. No. 08/136,797 can be included in the detergent composition of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166. +195, +197, +204, +206, +210, +216, +217, +218, +222, +260, +265, and/or +274 according to the numbering of *Bacillus amyloliquefaciens subtilisin,* as described in WO 95/10615 published Apr. 20, 1995 by Genencor International (A. Baeck et al. entitled "Protease-Containing Cleaning Compositions" having U.S. Ser. No. 08/322,676, filed Oct. 13, 1994).

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Protease enzyme may be incorporated into the compositions in accordance with the invention at a level of from 0.0001% to 2% active enzyme by weight of the composition.

Amylase—Amylases (α and/or β) can be included for removal of carbohydrate-based stains. Suitable amylases are Termamyl® (Novo Nordisk), Fungamyl® and BAN® (Novo Nordisk). The enzymes may be of any suitable origin, such as vegetable, animal, bacterial, fungal and yeast origin. Amylase enzymes are normally incorporated in the detergent composition at levels from 0.0001% to 2%, preferably from about 0.0001% to about 0.5%, more preferably from about 0.0005% to about 0.1%, even more preferably from about 0.001% to about 0.05% of active enzyme by weight of the detergent composition.

Amylase enzymes also include those described in WO95/26397 and in co-pending application by Novo Nordisk PCT/DK96/00056. Other specific amylase enzymes for use in the detergent compositions of the present invention therefore include:

(a) α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Such Phadebas® α-amylase activity assay is described at pages 9–10, WO95/26397.

(b) α-amylases according (a) comprising the amino sequence shown in the SEQ ID listings in the above cited reference or an α-amylase being at least 80% homologous with the amino acid sequence shown in the SEQ ID listing.

(c) α-amylases according (a) obtained from an alkalophilic Bacillus species, comprising the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp.

A polypeptide is considered to be X% homologous to the parent amylase if a comparison of the respective amino acid sequences, performed via algorithms, such as the one described by Lipman and Pearson in Science 227, 1985, p. 1435, reveals an identity of X%

(d) α-amylases according (a–c) wherein the α-amylase is obtainable from an alkalophilic Bacillus species; and in particular, from any of the strains NCIB 12289, NCIB 12512, NCIB 12513 and DSM 935.

In the context of the present invention, the term "obtainable from" is intended not only to indicate an amylase produced by a Bacillus strain but also an amylase encoded by a DNA sequence isolated from such a Bacillus strain and produced in an host organism transformed with said DNA sequence.

(e) α-amylase showing positive immunological cross-reactivity with antibodies raised against an α-amylase having an amino acid sequence corresponding respectively to those α-amylases in (a–d).

(f) Variants of the following parent α-amylases which (i) have one of the amino acid sequences shown in corresponding respectively to those α-amylases in (a–e), or (ii) displays at least 80% homology with one or more of said amino acid sequences, and/or displays immunological cross-reactivity with an antibody raised against an α-amylase having one of said amino acid sequences, and/or is encoded by a DNA sequence which hybridizes with the same probe as a DNA sequence encoding an α-amylase having one of said amino acid sequence, in which variants:

1. at least one amino acid residue of said parent α-amylase has been deleted; and/or
2. at least one amino acid residue of said parent α-amylase has been replaced by a different amino acid residue; and/or
3. at least one amino acid residue has been inserted relative to said parent α-amylase;

said variant having an α-amylase activity and exhibiting at least one of the following properties relative to said parent α-amylase:increased thermostability, increased stability towards oxidation, reduced Ca ion dependency, increased stability and/or α-amylolytic activity at neutral to relatively high pH values, increased α-amylolytic activity at relatively high temperature and increase or decrease of the isoelectric point (pI) so as to better match the pI value for α-amylase variant to the pH of the medium. Said variants are described in the patent application PCT/DK96/00056.

Other amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases regardless of whether one, two or multiple amylase strains are the immediate precursors. Oxidative stability-enhanced amylases vs. the above-identified reference amylase are preferred for use, especially in bleaching, more preferably oxygen bleaching as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;* (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme. modifications are accessible. See WO 9509909 A to Novo.

Various carbohydrase enzymes which impart antimicrobial activity may also be included in the present invention. Such enzymes include endoglycosidase, Type II endoglycosidase and glucosidase as disclosed in U.S. Pat. Nos. 5,041,236, 5,395,541, 5,238,843 and 5,356,803 the disclosures of which are herein incorporated by reference. Of course, other enzymes having antimicrobial activity may be employed as well including peroxidases, oxidases and various other enzymes.

It is also possible to include an enzyme stabilization system into the compositions of the present invention when any enzyme is present in the composition.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes typically comprise from about 0.01% to about 2%, by weight, of the detergent compositions herein, and individual perfumery ingredients can comprise from about 0.0001% to about 90% of a finished perfume composition.

Non-limiting examples of perfume ingredients useful herein include: 7-acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxy-phenylbutanone; benzophenone; methyl beta-naphthyl ketone; 6-acetyl-1,1,2,3,3,5-hexamethyl indane; 5-acetyl-3-isopropyl-1,1,2,6-tetramethyl indane; 1-dodecanal, 4-(4-hydroxy-4-methylpentyl)-3-cyclohexene-1-carboxaldehyde; 7-hydroxy-3,7-dimethyl ocatanal; 10-undecen-1-al; iso-hexenyl cyclohexyl carboxaldehyde; fornnyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)-propionaldehyde; ethyl vanillin, heliotropin; hexyl cinnamic aldehyde; amyl cinnamic aldehyde; 2-methyl-2-(para-iso-propylphenyl)-propionaldehyde; coumarin; decalactone gamma; cyclopentadecanolide; 16-hydroxy-9-hexadecenoic acid lactone; 1,3,4,6,7,8-hexahydro-4,6,6,7,8,8-hexamethylcyclopenta-gamma-2-benzo-pyrane: beta-naphthol methyl ether; ambroxane; dodecahydro-3a,6,6,9a-tetramethyl-naphtho[2,1b] furan; cedrol, 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; tricyclodecenyl propionate; tricyclodecenyl acetate; benzyl salicylate; cedryl acetate; and para-(tert-butyl) cyclohexyl acetate.

Particularly preferred perfume materials are those that provide the largest odor improvements in finished product compositions containing cellulases. These perfumes include but are not limited to: hexyl cinnamic aldehyde; 2-methyl-3-(para-tert-butylphenyl)-propionaldehyde; 7-acetyl-1,2,3,4,5,6,7,8-octahydro-1,1,6,7-tetramethyl naphthalene; benzyl salicylate; 7-acetyl-1,1,3,4,4,6-hexamethyl tetralin; para-tert-butyl cyclohexyl acetate; methyl dihydro jasmonate; beta-napthol methyl ether; methyl beta-naphthyl ketone; 2-methyl-2-(para-iso-propylphenyl)-propionaldehyde; 1,3,4,6,7,8-hexahydro-4,6,6,7,8,8-hexamethyl-cyclopenta-gamma-2-benzopyrane; dodecahydro-3a,6,6,9a-tetramethylnaphtho[2,1b]furan; anisaldehyde; coumarin; cedrol; vanillin; cyclopentadecanolide; tricyclodecenyl acetate; and tricyclodecenyl propionate.

Other perfume materials include essential oils, resinoids, and resins from a variety of sources including, but not limited to: Peru balsam, Olibanum resinoid, styrax, labdanum resin, nutmeg, cassia oil, benzoin resin, coriander and lavandin. Still other perfurme chemicals include phenyl ethyl alcohol, terpineol, linalool, linalyl acetate, geraniol, nerol, 2-(1,1-dimethylethyl)-cyclohexanol acetate, benzyl acetate, and eugenol. Carriers such as diethylphthalate can be used in the finished perfume compositions.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetrace-tates, N-hydroxyethylethylenediaminetriacetates, nitrilo-triacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, these chelating agents will generally comprise from about 0.1% to about 15% by weight of the detergent compositions herein. More preferably, if utilized, the chelating agents will comprise from about 0.1% to about 3.0% by weight of such compositions.

Composition pH

Dishwashing compositions of the invention will be subjected to acidic stresses created by food soils when put to use, i.e., diluted and applied to soiled dishes. If a composition with a pH greater than 7 is to be more effective, it preferably should contain a buffering agent capable of providing a generally more alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 10. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are Tri (hydroxymethyl)amino methane (HOCH2)3CNH3 (TRIS), 2-amino-2-ethyl-1,3-propanediol, 2-amino-2-methyl-propanol, 2-amino-2-methyl-1,3-propanol, disodium glutamate, N-methyl diethanolamide, 1,3-diamino-propanol N,N'-tetra-methyl-1,3-diamino-2-propanol, N,N-bis(2-hydroxyethyl)glycine (bicine) and N-tris (hydroxymethyl) methyl glycine (tricine). Mixtures of any of the above are also acceptable. Useful inorganic buffers/alkalinity sources include the alkali metal carbonates and alkali metal phosphates, e.g., sodium carbonate, sodium polyphosphate. For additional buffers see McCutcheon's EMULSIFIERS AND DETERGENTS, North American Edition, 1997, McCutcheon Division, MC Publishing Company Kirk and WO 95/07971 both of which are incorporated herein by reference.

The buffering agent, if used, is present in the compositions of the invention herein at a level of from about 0.1% to 15%, preferably from about 1% to 10%, most preferably from about 2% to 8%, by weight of the composition.

Other Ingredients—The detergent compositions will further preferably comprise one or more detersive adjuncts selected from the following: soil release polymers, polymeric dispersants, electrolytes (such as sodium chloride), polysaccharides, abrasives, bactericides, tarnish inhibitors, builders, enzymes, dyes, buffers, antifungal or mildew control agents, insect repellents, perfumes, hydrotropes, thickeners, processing aids, suds boosters, brighteners, anticorrosive aids, stabilizers antioxidants and chelants. A wide variety of other ingredients useful in detergent compositions can be included in the compositions herein, including other active ingredients, carriers, hydrotropes, antioxidants, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl-4-methylphenol (BHT), carbamate, ascorbate, thiosulfate, monoethanolamine(MEA), diethanolamine, triethanolamine, etc. It is preferred that the antioxidant, when present, be present in the composition from about 0.001% to about 5% by weight.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5 X the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Further, these hand dishwashing detergent embodiments preferably further comprises a hydrotrope. Suitable hydrotropes include sodium, potassium, ammonium or water-soluble substituted ammonium salts of toluene sulfonic acid, naphthalene sulfonic acid, cumene sulfonic acid, xylene sulfonic acid.

The detergent compositions of this invention can be in any form, including granular, paste, gel or liquid. Highly preferred embodiments are in liquid or gel form. Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

An example of the procedure for making granules of the detergent compositions herein is as follows:—Linear aklylbenzenesulfonate, citric acid, sodium silicate, sodium sulfate perfume, diamine and water are added to, heated and mixed via a crutcher. The resulting slurry is spray dried into a granular form.

An example of the procedure for making liquid detergent compositions herein is as follows:—To the free water and citrate are added and dissolved. To this solution amine oxide, betaine, ethanol, hydrotrope and nonionic surfactant are added. If free water isn't available, the citrate are added to the above mix then stirred until dissolved. At this point, an acid is added to neutralize the formulation. It is preferred that the acid be chosen from organic acids such as maleic and citric, however, inorganic mineral acids may be employed as well. In preferred embodiments these acids are added to the formulation followed by diamine addition. AExS is added last.

Non-Aqueous Liquid Detergents

The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. No. 4,988,462; U.S. Pat. No. 5,266,233; EP-A-225,654 (Jun. 16, 1987); EP-A-510,762 (Oct. 28, 1992); EP-A-540,089 (May 5, 1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients stably suspended therein. Such non-aqueous compositions thus comprise a LIQUID PHASE and, optionally but preferably, a SOLID PHASE, all as described in more detail hereinafter and in the cited references.

The compositions of this invention can be used to form aqueous washing solutions for use hand dishwashing. Generally, an effective amount of such compositions is added to water to form such aqueous cleaning or soaking solutions. The aqueous solution so formed is then contacted with the dishware, tableware, and cooking utensils.

An effective amount of the detergent compositions herein added to water to form aqueous cleaning solutions can comprise amounts sufficient to form from about 500 to 20,000 ppm of composition in aqueous solution. More preferably, from about 800 to 5,000 ppm of the detergent compositions herein will be provided in aqueous cleaning liquor.

The following examples are illustrative of the present invention, but are not meant to limit or otherwise define its scope. All parts, percentages and ratios used herein are expressed as percent weight unless otherwise specified.

In the following Examples all levels are quoted as % by weight of the composition.

EXAMPLES

TABLE I

| | Example 1 | Example 2 |
|---|---|---|
| AE0.6S[1] | 28.80 | 28.80 |
| Amine oxide[2] | 7.20 | 7.20 |
| Citric acid | 3.00 | — |
| Maleic acid | — | 2.50 |
| Suds boosting polymer[3] | 0.22 | 0.22 |
| Sodium Cumene Sulfonate | 3.30 | 3.30 |
| Ethanol 40B | 6.50 | 6.50 |
| C10E8 | — | — |
| C11E9[4] | 3.33 | 3.33 |
| Diamine[5] | 0.55 | 0.55 |
| Perfume | 0.31 | 0.31 |
| Water | BAL. | BAL. |
| Viscosity (cps @ 70F) | 330 | 330 |
| pH @ 10% | 9.0 | 9.0 |

TABLE II

| | Example 3 | Example 4 | Example 5 | Example 6 | Example 7 |
|---|---|---|---|---|---|
| AE0.6S[1] | 26 | 26 | 26 | 26 | 26 |
| Amine oxide[2] | 6.5 | 6.5 | 7.5 | 7.5 | 7.5 |

TABLE II-continued

| | Example 3 | Example 4 | Example 5 | Example 6 | Example 7 |
|---|---|---|---|---|---|
| Citric acid | 3.0 | — | 2.5 | — | 3.0 |
| Maleic acid | — | 2.5 | — | 3.0 | — |
| C10E8[6] | 3 | 3 | 4.5 | 4.5 | 4.5 |
| Diamine[5] | 0.5 | 0.5 | 1.25 | 0 | 1.25 |
| Diamine[7] | 0 | 0 | 0 | 1 | |
| Suds boosting polymer[3] | 0 | 0.2 | 0.5 | 0.5 | 0.5 |
| Sodium cumene sulphonate | 3.5 | 3.5 | 2 | 2 | 2 |
| Ethanol | 8 | 8 | 8 | 8 | 8 |
| pH | 9 | 9 | 9 | 8 | 10 |
| Molar ratio anionic:amine oxide:diamine | 27:8:1 | 27:8:1 | 11:3.5:1 | 11:3.5:1 | 11:3.5:1 |

TABLE III

| | Example 8 | Example 9 | Example 10 | Example 11 |
|---|---|---|---|---|
| AE0.6S[1] | 26.09 | 26.09 | 26.09 | 28.80 |
| Amine oxide[2] | 6.50 | 6.50 | 6.50 | 7.20 |
| Suds boosting polymer[3] | 0.20 | 0.20 | 0.20 | 0.22 |
| Sodium Cumene Sulfonate | 3.50 | 3.50 | 3.50 | 3.90 |
| C10E8 | 3.00 | 3.00 | 3.00 | 3.30 |
| Diamine[5] | 0.50 | 0.50 | 0.50 | 0.55 |
| Water and Misc. | BAL. | BAL. | BAL. | BAL. |
| Viscosity (cps @ 70F) | 150 | 330 | 650 | 330 |
| pH @ 10% | 8.3 | 9.0 | 9.0 | 9.0 |

[1]C12–13 alkyl ethoxy sulfonate containing an average of 0.6 ethoxy groups.
[2]$C_{12}$–$C_{14}$ Amine oxide.
[3]Polymer is (N,N-dimethylamino)ethyl methacrylate homopolymer
[4]C11 Alkyl ethoxylated surfactant containing 9 ethoxy groups.
[5]1,3 bis(methylamine)-cyclohexane.
[6]C10 Alkyl ethoxylated surfactant containing 8 ethoxy groups.
[7]1,3 pentane diamine.

What is claimed is:

1. A hand dishwashing detergent composition comprising:

a) a low molecular weight organic diamine having a pK1 and a pK2, wherein t the pK1 and the pK2 of said diamine are both in the range of from 8.0 to 11.5;

b) an anionic surfactant; and c) an amine oxide surfactant;

wherein said composition contains less than about 5% by weight of magnesium and calcium salts; wherein the pH (as measured as 10% aqueous solution) is from 5.0 to 12.5 and wherein the mole ratio of said anionic surfactant to said amine oxide to said diamine is from about 27:8:1 to about 11:3:1.

2. A hand dishwashing detergent composition according to claim 1 further comprising a nonionic surfactant is selected from the group consisting of, polyhydroxy fatty acid amides, betaines, sulfobetaines, alkyl polyglycosides, alkyl ethoxylates, and mixtures thereof.

3. A hand dishwashing detergent composition according to claim 1 wherein said anionic surfactant is selected form the group consisting of linear alkylbenzene sulfonate, alpha olefin sulfonate, paraffin sulfonates, methyl ester sulfonates, alkyl sulfates, alkyl alkoxy sulfate, alkyl sulfonates, alkyl alkoxylated sulfates, sarcosinates, taurinates, alkyl alkoxy carboxylate, and mixtures thereof.

4. A hand dishwashing detergent composition according to claim 1 wherein said diamine is selected from the group consisting of:

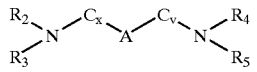

wherein $R_{2-5}$ are independently selected from H, methyl, ethyl, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range; wherein if A is present, then both x and y must be 2 or greater.

5. A hand dishwashing detergent composition according to claim 1 wherein said diamine is selected from the group consisting of dimethyl aminopropyl amine, 1,6-hexane diamine, 1,3 propane diamine, 2-methyl 1,5 pentane diamine, 1,3-Pentanediamine, 1,3-diaminobutane, 1,2-bis(2-aminoethoxy)ethane, Isophorone diamine, 1,3-bis (methylamine)-cyclohexane and mixtures thereof.

6. A hand dishwashing detergent composition according to claim 1 wherein said anionic surfactant is selected from the group consisting of alkyl sulfates, alkyl alkoxy sulfates, and mixtures thereof.

7. A hand dishwashing detergent composition according to claim 1 further comprising a polycarboxylate builder wherein said polycarboxylate builder is selected from the group consisting of citric acid, maleic acid, derivatives of succinic acid and mixtures thereof.

8. A hand dishwashing detergent composition according to claim 2 wherein said nonionic surfactant is an alkylethoxylate.

9. A hand dishwashing detergent composition according to claim 1 further comprising a polymeric suds stabilizer selected from the group consisting of:

i) homopolymers of (N,N-dialkylamino)alkyl acrylate esters having the formula:

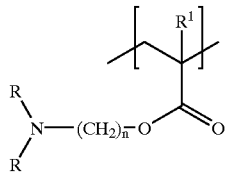

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

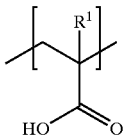

wherein $R^1$ is hydrogen, C1–C6 alkyl, and mixtures thereof; provided that the ratio of (ii) to (i) is from about 2 to 1 to about 1 to 2; and wherein said polymeric suds stabilizer has a molecular weight of from about 1,000 to about 2,000,000 daltons.

10. A hand dishwashing detergent composition according to claim 1 further comprising a hydrotrope.

11. A hand dishwashing detergent composition according to claim 2 further comprising one or more detersive adjuncts selected from the following: soil release polymers, polymeric dispersants, polysaccharides, abrasives, bactericides, tarnish inhibitors, builders, enzymes, dyes, perfumes, thickeners, antioxidants, processing aids, suds boosters, buffers, antifungal or mildew control agents, insect repellants, anti-corrosive aids, and chelants.

12. A hand dishwashing detergent composition according to claim 1 in liquid form.

13. A hand dishwashing detergent composition according to claim 1 wherein said diamine contains less than 5% by weight of impurities.

14. A detergent composition suitable for use in hand dishwashing, said composition comprising:

a) from about 0.1% to about 5% by weight of an organic diamnine having a molecular weight less than or equal to 400 g/mol;

b) from about 5% to about 50% by weight of an anionic surfactant;

c) from about 0.5% to about 10% by weight of an amine oxide surfactant;

d) from about 0.001% to about 2% by weight of a perfume;

e) from about 0.01% to about 5% by weight of a polymeric suds stabilizer selected from the group consisting of:

i) homopolymers of (N,N-dialkylamino)alkyl acrylate esters having the formula:

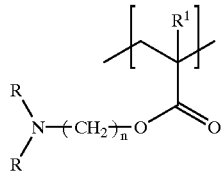

wherein each R is independently hydrogen, $C_1$–$C_8$ alkyl and mixtures thereof; $R^1$ is hydrogen, $C_1$–$C_6$ alkyl and mixtures thereof; n is from 2 to about 6; and ii) copolymers of i) and

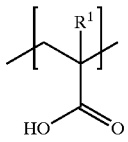

wherein $R^1$ is as described above; provided that the ratio of ii) to i) is from about 2:1 to about 1:2; and wherein said polymer suds stabilizer has a molecular weight of from about 1,000 to about 2,000,000 daltons;

wherein said composition contains less than about 5% by weight of magnesium and calcium salts; wherein the pH (as measured as 10% aqueous solution) is from 5.0 to 12.5 and wherein the mole ratio of said anionic surfactant to said amine oxide to said diamine is from about 27:8:1 to about 11:3:1.

15. A detergent composition according to claim 14 wherein said diamine has the formula:

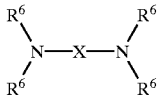

wherein each $R^6$ is independently selected from the group consisting of hydrogen, $C_1$–$C_4$ linear or branched alkyl, alkyleneoxy having the formula:

$$—(R^7O)_mR^8$$

wherein $R^7$ is $C_2$–$C_4$ linear or branched alkylene, and mixtures thereof; $R^8$ is hydrogen, $C_1$–$C_4$ alkyl, and mixtures thereof; m is from 1 to about 10; X is a unit selected from:

i) $C_3$–$C_{10}$ linear alkylene, $C_3$–$C_{10}$ branched alkylene, $C_3$–$C_{10}$ cyclic alkylene, $C_3$–$C_{10}$ branched cyclic alkylene, an alkyleneoxyalkylene having the formula:

$$—(R^7O)_mR^7—$$

wherein $R^7$ and m are the same as defined herein above;

ii) $C_3$–$C_{10}$ linear, $C_3$–$C_{10}$ branched linear, $C_3$–$C_{10}$ cyclic, $C_3$–$C_{10}$ branched cyclic alkylene, $C_6$–$C_{10}$ arylene, wherein said unit comprises one or more electron donating or electron withdrawing moieties which provide said diamine with a $pK_a$ greater than about 8; and iii) mixtures of (i) and (ii)

provided said diamine has a $pK_a$ of at least about 8.

16. A detergent composition according to claim 14 further comprising from about 0.5% to about 20%, by weight of a nonionic surfactant selected from the group consisting of polyhydroxy fatty acid amides, betaines, sulfobetaines, alkyl polyglycosides, alkyl ethoxylates, and mixtures thereof.

17. A hand dishwashing detergent composition according to claim 1 further comprising from about 0.1% to about 15% by weight of a buffer with a pKa of from about 7 to about 10.

18. A hand dishwashing detergent composition according to claim 17 wherein said buffer is selected from the group consisting of alkali metal carbonate, alkali metal phosphate, lysine, Tri(hydroxymethyl)amino methane and mixtures thereof.

19. A method of washing tableware said method comprising contacting soiled tableware in need of cleaning with an aqueous solution of the composition according to claim 1.

20. A method of washing tableware said method comprising contacting soiled tableware in need of cleaning with an aqueous solution of the composition according to claim 14.

* * * * *

UNITED STATES PATENT AND TRADEMARK OFFICE

CERTIFICATE OF CORRECTION

PATENT NO. : 6,589,926 B1
DATED : July 8, 2003
INVENTOR(S) : Vinson et al.

It is certified that error appears in the above-identified patent and that said Letters Patent is hereby corrected as shown below:

Title page,
Item [22], PCT Filed, replace "Feb. 6, 1999", with -- Feb. 5, 1999 --

Signed and Sealed this

Ninth Day of March, 2004

JON W. DUDAS
*Acting Director of the United States Patent and Trademark Office*